US010526876B2

(12) United States Patent
Hess et al.

(10) Patent No.: US 10,526,876 B2
(45) Date of Patent: Jan. 7, 2020

(54) METHOD AND SYSTEM FOR HYDRAULIC COMMUNICATION WITH TARGET WELL FROM RELIEF WELL

(71) Applicant: Halliburton Energy Services, Inc, Houston, TX (US)

(72) Inventors: Joe E. Hess, Richmond, TX (US); Andy J. Cuthbert, Spring, TX (US); Carl J. Cramm, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 123 days.

(21) Appl. No.: 15/513,089

(22) PCT Filed: Oct. 30, 2014

(86) PCT No.: PCT/US2014/063220

§ 371 (c)(1),
(2) Date: Mar. 21, 2017

(87) PCT Pub. No.: WO2016/068956

PCT Pub. Date: May 6, 2016

(65) Prior Publication Data

US 2018/0320490 A1 Nov. 8, 2018

(51) Int. Cl.
*E21B 43/119* (2006.01)
*E21B 43/117* (2006.01)
(Continued)

(52) U.S. Cl.
CPC ..... *E21B 43/117* (2013.01); *E21B 7/04* (2013.01); *E21B 33/128* (2013.01);
(Continued)

(58) Field of Classification Search
CPC ..... E21B 43/119; E21B 43/117
See application file for complete search history.

(56) References Cited

U.S. PATENT DOCUMENTS 3,012,608 A * 12/1961 McLaren, Jr. ..... E21B 43/119 166/125
3,063,372 A * 11/1962 Diebold ..... E21B 23/14 166/55.1

(Continued)

OTHER PUBLICATIONS

International Search Report and the Written Opinion of the International Search Authority, or the Declaration, dated Jul. 30, 2015, PCT/US2014/063220, 14 pages, ISA/KR.

(Continued)

*Primary Examiner* — Kipp C Wallace

(57) ABSTRACT

A system and method for establishing hydraulic communication between relief and target wells, wherein a relief well is drilled to include a portion of the target wellbore that is axially offset from and substantially parallel to a portion of the relief wellbore. A perforating system is carried by a tubing string in a cased portion of the relief well. The perforating system includes a latch assembly, a non-rotational packer and perforating gun having charges radially oriented in a limited direction. Tubing string parameters are obtained during the run-in of the perforating system, and thereafter the tubing string parameters are utilized to engage the latch assembly with a latch coupling carried by the casing in the relief wellbore. Axial and rotational forces are applied to the tubing string to engage the latch assembly. Discharge of the perforating gun yields perforations only between the relief well and target well, establishing fluid communication.

26 Claims, 7 Drawing Sheets

(51) Int. Cl.

| | |
|---|---|
| ***E21B 43/12*** | (2006.01) |
| ***E21B 7/04*** | (2006.01) |
| ***E21B 33/128*** | (2006.01) |
| ***E21B 33/129*** | (2006.01) |
| ***E21B 43/30*** | (2006.01) |

(52) U.S. Cl.
CPC ..... *E21B 33/1292* (2013.01); *E21B 43/119* (2013.01); *E21B 43/12* (2013.01); *E21B 43/305* (2013.01)

(56) References Cited

U.S. PATENT DOCUMENTS 3,143,170 A * 8/1964 Nelson ..... E21B 43/119 166/255.2
3,211,231 A * 10/1965 Bramlett ..... E21B 41/00 166/128
3,465,836 A * 9/1969 Fields ..... E21B 23/10 166/55.1
4,436,154 A * 3/1984 Vann ..... E21B 29/08 166/271
4,949,793 A * 8/1990 Rubbo ..... E21B 23/00 166/134
5,044,437 A * 9/1991 Wittrisch ..... E21B 17/06 166/113
5,103,920 A 4/1992 Patton
5,226,494 A * 7/1993 Rubbo ..... E21B 23/00 166/250.17
5,318,117 A 6/1994 Echols, III et al.
5,579,829 A * 12/1996 Comeau ..... E21B 7/061 166/117.6
6,199,632 B1 * 3/2001 Shy ..... E21B 23/04 166/212
6,202,746 B1 * 3/2001 Vandenberg ..... E21B 7/061 166/117.6
2002/0062960 A1 * 5/2002 George ..... E21B 33/12 166/278
2004/0144539 A1 * 7/2004 Smith ..... E21B 43/119 166/297
2004/0145969 A1 7/2004 Bai et al.
2005/0006098 A1 * 1/2005 Hoffman ..... E21B 33/134 166/305.1
2013/0118809 A1 5/2013 Veeningen
2013/0153295 A1 6/2013 Rodgers et al.
2013/0319693 A1 * 12/2013 Sponchia ..... E21B 10/64 166/384
2014/0020896 A1 * 1/2014 Al-Gouhi ..... E21B 43/117 166/297

OTHER PUBLICATIONS

Intellectual Property Office of Singapore, Search Report and Written Opinion, Application No. 11201701900R, dated May 31, 2018, 9 pages, Singapore.

* cited by examiner

METHOD AND SYSTEM FOR HYDRAULIC COMMUNICATION WITH TARGET WELL FROM RELIEF WELL

PRIORITY

The present application is a U.S. National Stage patent application of International Patent Application No. PCT/US2014/063220, filed on Oct. 30, 2014, the benefit of which is claimed and the disclosure of which is incorporated herein by reference in its entirety.

BACKGROUND

Technical Field

Embodiments disclosed herein relate to well intervention operations in hydrocarbon exploration. In particular, embodiments disclosed herein relate to the development of hydraulic communication between a target and a relief well without the need to intersect the two wells.

Description of Related Art

In the field of hydrocarbon exploration and extraction, it is sometimes necessary to establish fluid communication between two wells.

One example occurs in the situation where it becomes necessary to drill a relief well to intersect an existing well, as in the case where the casing of the existing well has ruptured and it becomes necessary to plug the existing well at or below the point of the rupture to bring it under control. In order to do this, the relief well must be drilled to intersect the original well at the desired level, thus establishing fluid communication between the two wells. The relief well provides a conduit for injecting a fluid, such as mud or cement, into the existing, or target, well.

Since such ruptures, or blowouts, often produce extremely hazardous conditions at the surface in the vicinity of the original well, the relief well usually must be started a considerable distance away from the original wellhead. A relief well is typically drilled as a generally vertical hole down to a planned kickoff point, where the relief well is turned toward the target well using conventional directional drilling technology and thereafter drilled as a deviated well. Drilling of the deviated portion of the relief well is thereafter continued until the relief well intersects the target well, thereby establishing hydraulic communication between the two wells.

Because the same problems of control of the direction of drilling that were encountered in the original well are also encountered in drilling the relief well, the location of the relief well borehole also cannot be known with precision; accordingly, it is extremely difficult to determine the distance and direction from the end of the relief well to the desired point of intersection on the target well. In addition, the relief well usually is very complex, compounding the problem of knowing exactly where it is located with respect to a target that may be 10 inches in diameter at a distance of thousands of feet below the earth's surface.

Moreover, in order to minimize the risk of bit or mill deflection, whereby the bit or mill of the relief well is deflected by the casing of the target well upon impact, the incident angle, i.e., the angle at intersection of the two wellbores, is commonly kept to no more than 6 degrees. Because of the small size of the intersection point, greater care must be exercised during the final approach and breach, which costs time and tries patience, in order to intersect the two wells to establish fluid communication.

DETAILED DESCRIPTION

Figure 1:
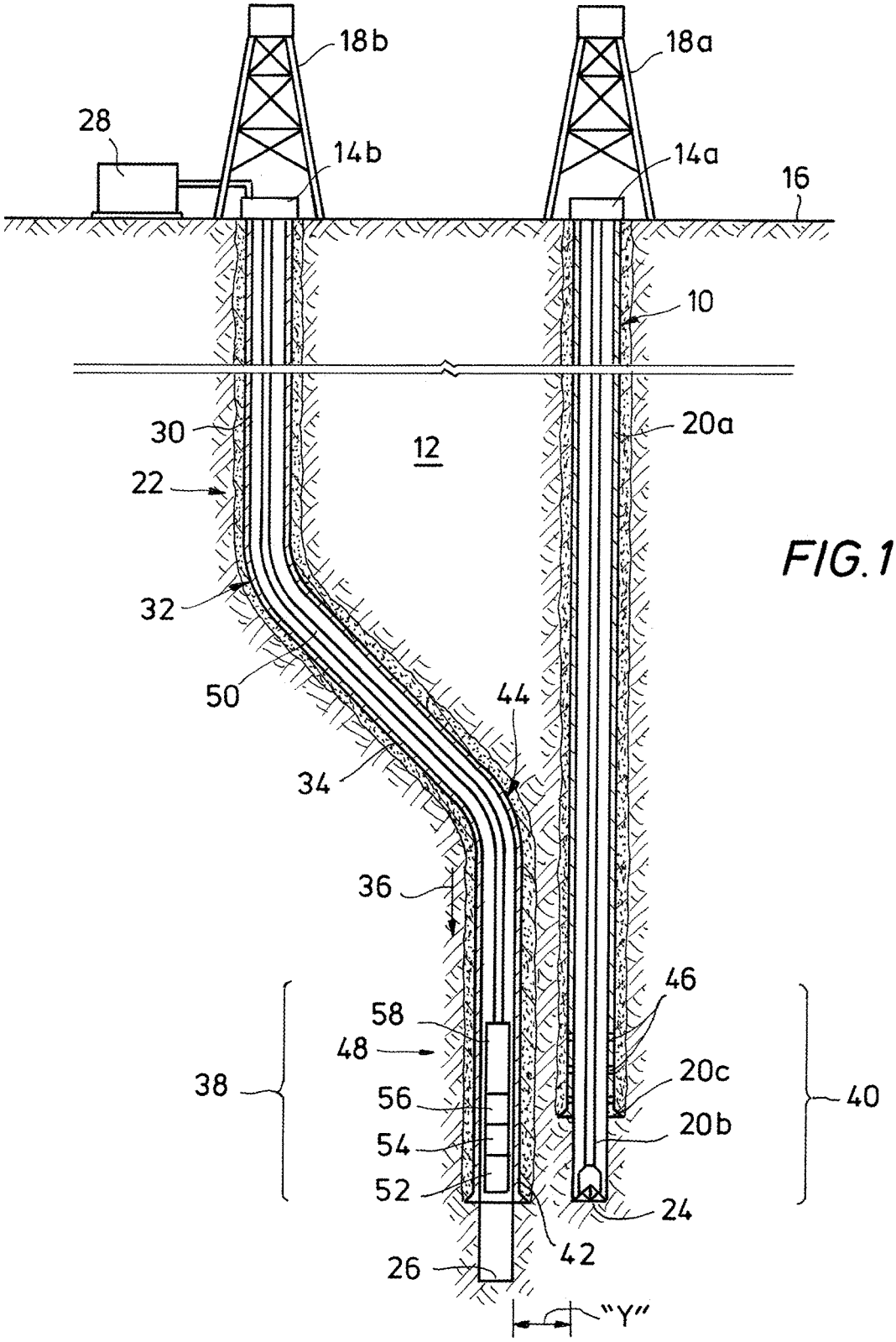
FIG. 1 shows the trajectory of a relief well relative to a target well according to some embodiments.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Wellbore fluid communication for relief wells, coalbed methane drilling, wellbore re-entries for remediation, enhanced production, or plug and abandon operations can be achieved by positioning a portion of a relief well to be adjacent, but spaced apart from a target well, and thereafter perforating in the radial direction of the target well. A latch mechanism is disposed in the casing of the relief well to axially and radially orient a perforation tool, thereby allowing discreet, selective discharge of the perforation tool only in the direction of the target well. A non-rotational packer may be utilized in conjunction with the latch mechanism to ensure that engagement of the latch does not affect sealing of the annulus of the relief well. With reference to FIG. 1, a first or target wellbore 10 is shown in a formation 12 extending from a well head 14 at the surface 16. Although first wellbore 10 may have any orientation, for purposes of the discussion, first wellbore 10 is illustrated as extending substantially vertically from the surface 16. To the extent first wellbore 10 is in the process of being drilled, a drilling structure 18*a* may be associated with first wellbore 10. In one or more embodiments, first wellbore 10 may include a conductive body 20, such as casing 20*a*, a drill string 20*b*, a casing shoe 20*c* or other metallic components. Well head 14 may generally include one or more of blow out preventers, chokes, valves, annular and ram blowout preventers, etc.

A second or relief wellbore 22 is also shown in the formation 12 extending from a well head 14 associated with a drilling structure 18*b*. Drilling structure 18*b* may be the same or a different drilling structure from drilling structure 18*a*. Drilling structures 18*a*, 18*b* are for illustrative purposes only and may be any type of drilling structure utilized to drill a wellbore, including land deployed drilling structures or marine deployed drilling structures. In this regard, the wellbores 10, 22 may extend from land or may be formed at the bottom of a body of water (not shown). In the illustrated embodiment, first wellbore 10 includes a distal or terminus end 24 and second wellbore 22 includes a distal or terminus end 26. Also illustrated is a fluid source 28 for fluid introduced into second wellbore 22.

Although the orientation of the second wellbore is not limited except as disclosed herein, in one or more embodiments, second wellbore 22 is drilled to have a substantially vertical portion 30 extending from surface 16, a kickoff point 32 and a deviated portion 34 extending from the kickoff point 32 along a select trajectory 36 so that second wellbore 22 is drilled so that a portion 38 of second wellbore 22 is disposed adjacent a portion 40 of first wellbore 10.

Preferably, portion 38 of second wellbore 22 is substantially parallel to portion 40 of first wellbore 10. The length of the respective parallel portions may be selected based on the amount of hydraulic communication necessary for a particular procedure. In certain embodiments, the length of the respective parallel portions may be approximately 10 to 40 meters, although other embodiments are not limited by such a distance. As noted above, the particular orientation of the parallel portions of the adjacent wellbores are not limited to a particular orientation so long as they are in proximity to one another as described herein.

It should be noted that first and second wellbores 10, 22 preferably do not intersect at the adjacent portions 38, 40, but are maintained in a spaced apart relationship from one another. In certain preferred embodiments, the spacing between the two wellbores at the adjacent portions 38, 40 is desirably between zero and 0.25 meters, although other embodiments are not limited by such a distance. It will be appreciated that the closer the second wellbore 22 is to the first wellbore 10, the more effective the method and system for establishing hydraulic communication therebetween.

Although the trajectory 36 of second wellbore 22 need not follow any particular path so long as a portion 38 is positioned relative to a portion 40 of the first wellbore 10, as shown, second wellbore 22 includes a first substantially vertical leg 42. Kickoff is initiated at point 32 in order to guide second wellbore 22 towards first wellbore 10. Any directional drilling and ranging techniques may be used at this point to guide second wellbore 14 towards first wellbore 10. Once second wellbore 14 has reached a desired offset distance, kickoff to tangent wellbore 10 is initiated at point 44 to form portion 38 of second wellbore 22.

As will be described below, hydraulic communication between second wellbore 22 and first wellbore 10 will be established at the respective adjacent portions 38, 40. First wellbore 10 may be cased or uncased at portion 40. To the extent portion 40 is cased, portion 40 may be selected to have perforations 46 (shown in FIG. 2) to permit hydraulic flow from second wellbore 22 into first wellbore 10 through formation 12

Finally, disposed within the second wellbore 22 is a perforating system 48 for establishing the fluid communication between the two wellbores 10, 22. Perforating system 48 is carried on a tubing string 50 extending from drilling structure 18*b*, and generally includes a latch assembly 52, a perforating gun 54, and a firing head 56. In one or more embodiments, perforating system 48 may further include a non-rotational packer 58.

Figure 2:
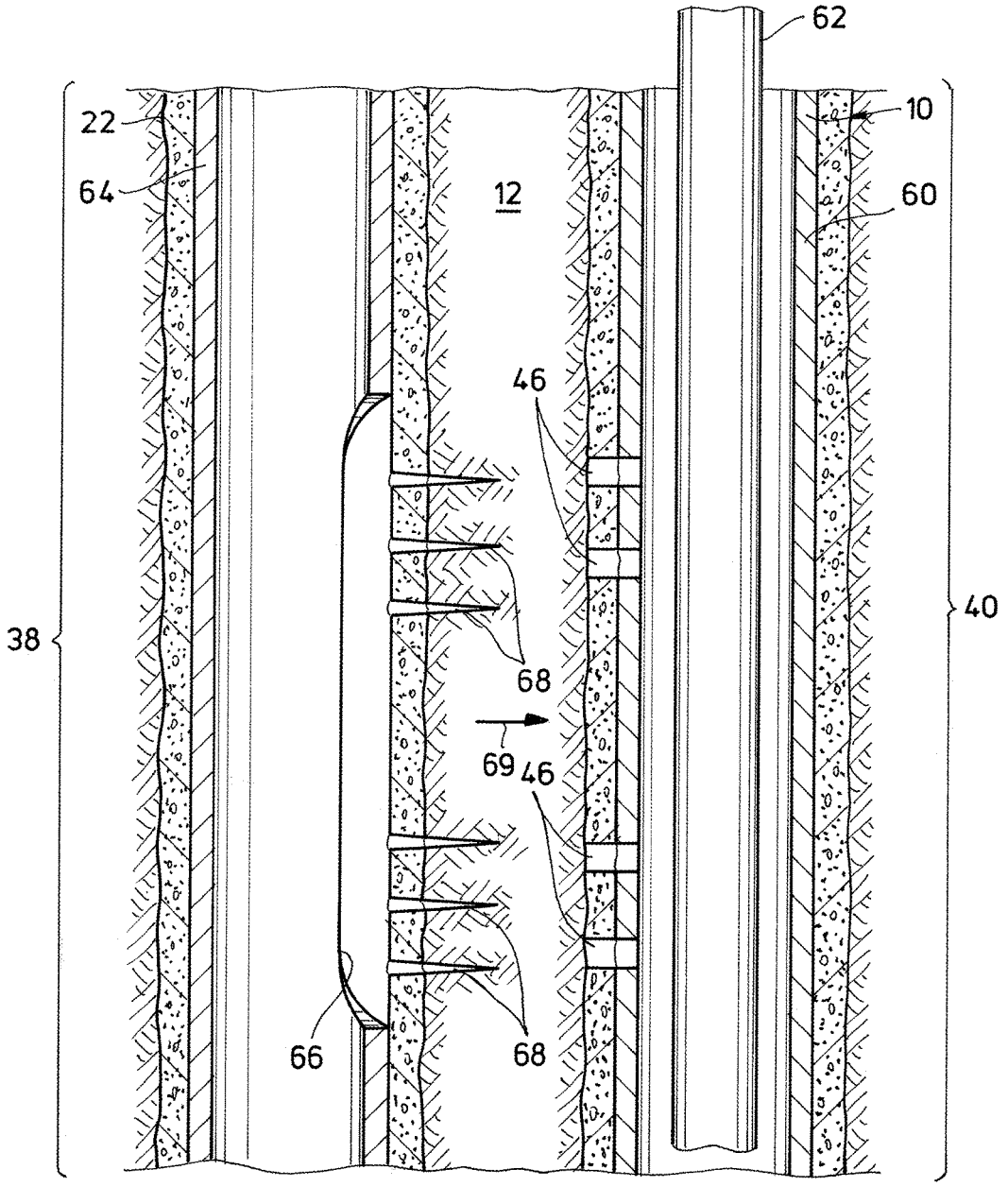
FIG. 2 shows a portion of a relief well aligned in parallel, spaced apart relation to a portion of a target well according to some embodiments.

Turning to FIG. 2, portion 38 of second wellbore 22 is illustrated adjacent portion 40 of first wellbore 10 such that fluid communication is established between the two wellbores when the formation 12 therebetween is perforated. In the illustration, first wellbore 10 includes casing 60, however, in other embodiments, first wellbore 10 may be uncased. Casing 60 is illustrated with a plurality of perforations 46. Perforations 46 may be existing perforations previously formed in wellbore 10 or alternatively, perforations 46 may be formed from wellbore 22 using a perforating system 48 as described herein. Likewise, first wellbore 10 may include conveyance pipe or tubing, a tool or tool string 62 such as a drill string, a completion string, or other types of systems deployed within first wellbore 10.

In one or more embodiments, second wellbore 22 includes casing 64. Casing 64 may include a milled window 66 disposed between second wellbore 22 and first wellbore 10 and through which perforations 68 are formed in the formation 12 between the two wellbores 10, 22. In one or more other embodiments, rather than a milled window 66, perforations 68 may be formed in casing 64 and extent out into formation 12 towards first wellbore 10. In any event, as described in more detail below, in one or more embodiments, perforations 68 are selectively formed about the radius of second wellbore xx so as to extend only between second wellbore 22 and first wellbore 10 in a select radial direction 69. Not only does this maximize fluid communication with first wellbore 10, it also minimizes inflow of formation fluid and minimizes the risk of damage to, as well as unintended fluid communication with, other wellbores which may be disposed in the formation 12 about first and second wellbores 10, 22.

Figure 3A:
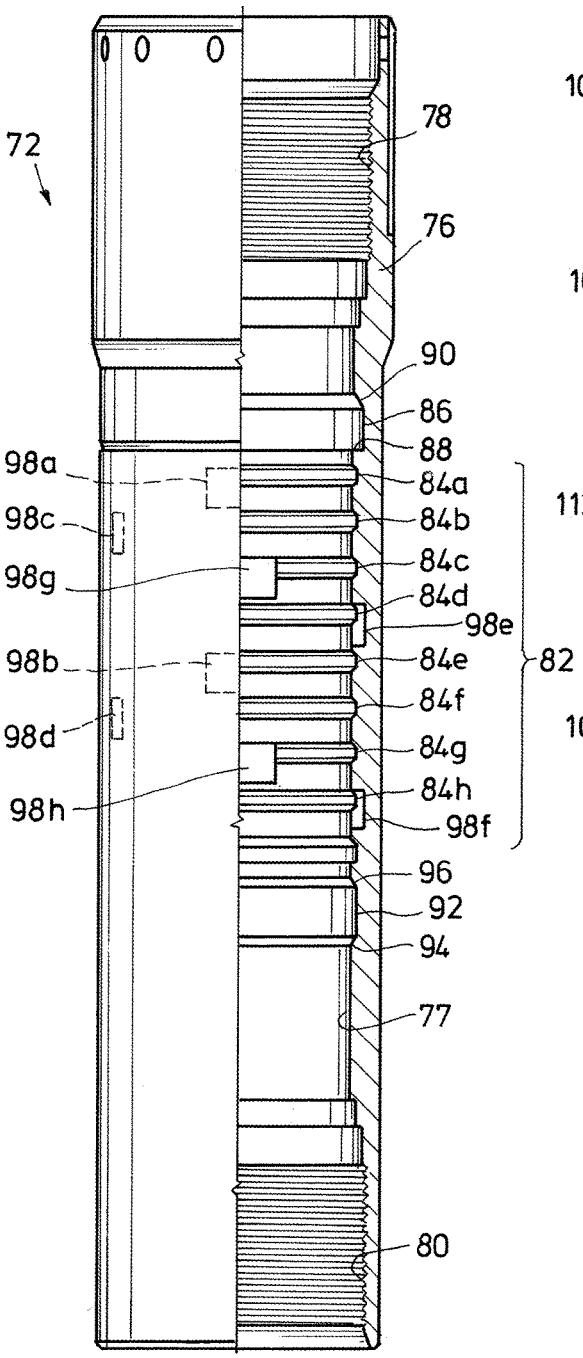
FIGS. 3A and 3B illustrate a latch system for use in a relief well according to some embodiments.
Figure 3B:
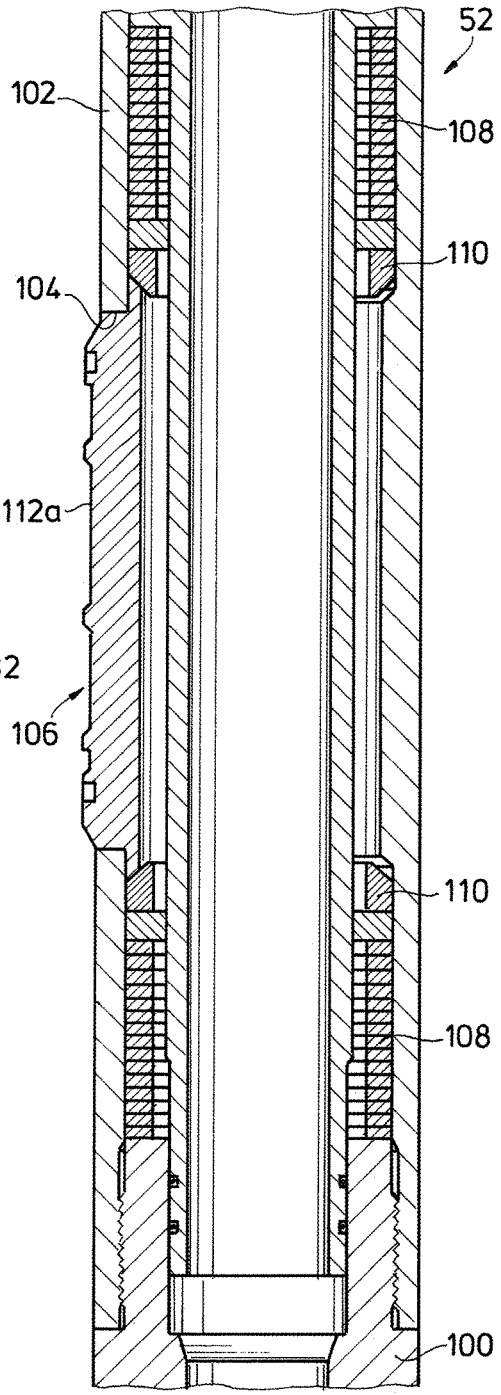

Turning to FIGS. 3A and 3B, a latch system 70 (see FIG. 6) is generally illustrated and comprised of a latch coupling 72 carried in the casing 64 of second wellbore 22, and a latch assembly 52 carried on tubing string 50. The disclosure is not limited to a particular type of latch system 70. However, for illustrative purposes, a general latch system will be described.

With particular reference to FIG. 3A, casing 64 includes a latch coupling 72 having a latch profile 82. It is noted that each latch coupling may have a unique latch profile that is different from the latch profile of another latch coupling. This enables selective engagement with a matching or mating set of latch keys (described below) in a desired latch assembly. Accordingly, latch coupling 72 is described herein to illustrate the type of elements and combination of elements that can be used to create any number of unique latch profiles.

Latch coupling 72 has a generally tubular body 76 having an internal bore 77, an upper connector 78 and a lower connector 80 suitable for connecting latch coupling 72 to other selections of casing 64 via a threaded connection, a pinned connection or the like. Latch coupling 72 includes an internal latch profile 82, along the internal bore 77, including a plurality of axially spaced apart recessed grooves 84, such as 84*a*-84*h* that extend circumferentially about bore 77 of latch coupling 72. Preferably, recessed grooves 84 extend about the entire circumference of internal bore 77 of latch coupling 72. Latch profile 82 also includes an upper groove 86 having a lower square shoulder 88 and an upper angled shoulder 90. Latch profile 82 further includes a lower groove 92 having a lower angled shoulder 94 and an upper angled shoulder 96.

Latch profile 82 also has a plurality of circumferential alignment elements depicted as a plurality of recesses 98 disposed within the inner bore 77 of latch coupling 72. In the illustrated embodiment, there are four sets of two recesses that are disposed in different axial and circumferential positions or locations within the inner bore 77 of latch coupling 72. For example, a first set of two recesses 98*a*, 98*b* are disposed along inner bore 77 at substantially the same circumferential positions and different axial positions. A second set of two recesses 98*c*, 98*d* are disposed along inner bore 77 at substantially the same circumferential positions and different axial positions. A third set of two recesses 98*e*, 98*f* are disposed along inner bore 77 at substantially the same circumferential positions and different axial positions. A fourth set of two recesses 98*g*, 98*h* are disposed along inner bore 77 at substantially the same circumferential positions and different axial positions.

As shown, recesses 98*a*, 98*b* are disposed within the inner surface of latch coupling 72 at a ninety degree circumferentially interval from recesses 98*c*, 98*d*. Likewise, recesses 98*c*, 98*d* are disposed within the inner surface of latch coupling 72 at a ninety degree circumferentially interval from recesses 98*e*, 98*f*. Finally, recesses 98*e*, 98*f* are disposed within the inner surface of latch coupling 72 at a ninety degree circumferentially interval from recesses 98*g*, 98*h*. Preferably, recesses 98 only partially extend circumferentially about the internal bore 77 of latch coupling 72.

Latch profile 82 including the circumferential alignment elements creates a unique mating pattern operable to cooperate with the latch key profile associated with a desired latch assembly, such as described below, to axially and circumferentially anchor and orient a perforating gun in a particular desired circumferential orientation relative to the latch coupling 72 during wellbore intervention operations. The specific profile of each latch coupling 72 can be created by varying one or more of the elements or parameters thereof. For example, the thickness, number and relative spacing of the recesses 98 can be altered.

With particular reference to FIG. 3B, one or more embodiments of a latch assembly 52 for use in circumferentially aligning the perforating gun 54 are depicted. Latch assembly 52 has an outer housing 100 disposed for engagement with tubing string 50. Outer housing 100 includes a key housing 102 having circumferentially distributed, axially extending key windows 104. Disposed within key housing 102 is a plurality of outwardly biased latch keys 106 that are operable to partially extend through key windows 104. In one or more embodiments, latch keys 106 are radially outwardly biased by upper and lower Belleville springs 108 that urge upper and lower conical wedges 110 under latch keys 106.

Each of the latch keys 106 has a unique key profile 112, such as key profiles 112*a*, that enables the anchoring and orienting functions of latch assembly 52 with a mating latch coupling 72 having the appropriate latch profile 82 (see FIG. 3A). As illustrated, key profile 112 includes a plurality of radial variations that must correspond with mating radial portions of a latch profile in order for a latch key 106 to operably engage with or snap into that latch profile. In order for each of the latch keys 106 to operably engage with a latch profile, the latch assembly 52 must be properly axially positioned within the mating latch coupling and properly circumferentially oriented within the mating latch coupling.

Figure 4:
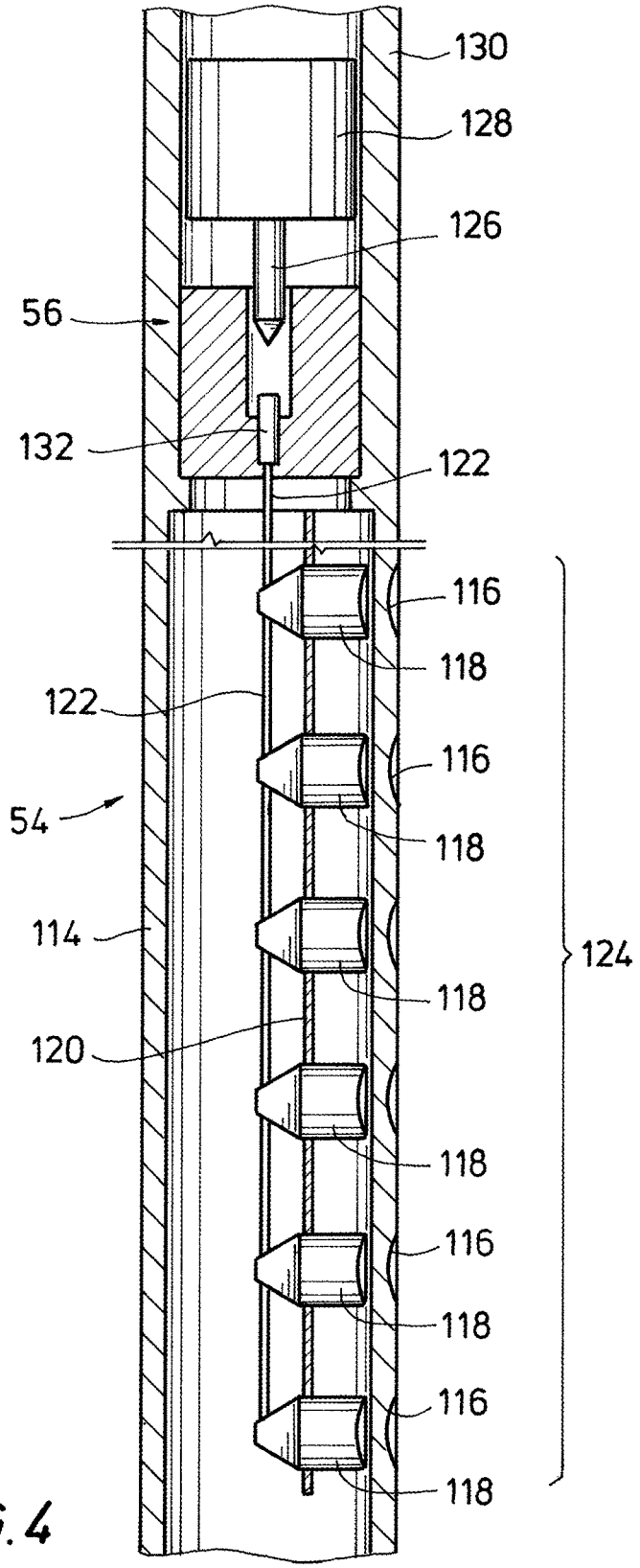
FIG. 4 illustrates a perforation tool that may be utilized in certain embodiments.

With reference to FIG. 4, a perforating gun is illustrated generally as 54. Other than the requirement that the perforating gun 54 have the ability to perforate in a discrete radial direction as discussed below, the disclosure is not limited to a particular type of perforating gun 54. However, for illustrative purposes, a general perforating gun will be described. In this regard, a loaded perforating gun 54 is assembled in a carrier or tubular housing 114, which may be for example, a length of straight wall tubing formed of high strength steel. Carrier 114 has gun ports, or thinned wall areas often referred to as scallops, 116 aligned with shaped charges 118 supported within the carrier 114. A charge holder 120 provides a frame for assembling the shaped charges 118 and connecting them with detonating cord 122. When the charge holder 120 is inserted in the carrier 114, the charge holder 120 holds the shaped charges 118 in alignment with the scallops 116. In one or more embodiments, a group of shaped charges 118 and scallops 116 are arranged in a linear configuration along a single side of perforating gun 54 so that the shaped charges 118 and scallops 116 face in only a limited or discreet radial direction (see FIG. 2, direction 69). Perforating gun 54, includes an extension of the detonating cord 122 carried in the interior of carrier 114 and interconnecting shaped charges 118 of a group.

In one or more alternative embodiments, the shaped charges 118 and scallops 116 may be arranged about the radius of carrier 114, such as in a helical or other configuration. However in such case, the shaped charges are not interconnected by detonating cord, but are selectively and individually detonatable, so that only those shaped charges 118 facing in a limited or discreet select radial direction may be detonated.

Alternatively, in one or more embodiments, perforating gun 54 may include multiple groups 124 of shaped charges 118 and scallops 116 arranged in a linear configuration, wherein each group 124 is spaced apart from the other groups 124 about the radius of carrier 114 and each group faces in only a limited or discreet radial direction that is different from the other groups. In such case, the shaped charges in a group 124 are interconnected by separate lengths of detonating cord 122, each group 124 being selectively and individually detonatable so that only those shaped charges 118 facing in a limited or discreet select radial direction may be detonated.

It will be appreciated that except as to the positioning of a charge or group of charges to fire in a limited or discreet radial direction, the perforating gun 54 described herein is not limited to a particular type of perforating gun assembly, and that the forgoing general components are provided for illustrative purposes only.

A firing head assembly 56 is also illustrated in FIG. 4. Firing head assembly 56 is utilized to detonate shaped charges 118 of perforating gun 54. Firing head assembly 56 is typically actuated through use of mechanical forces, fluid pressure or electricity. So-called mechanically-actuated firing heads are typically responsive to an impact, such as may be provided by the dropping of a detonating bar through the tubing to impact an actuation piston in the firing head. Hydraulically-actuated firing heads are responsive to a source of fluid pressure, either in the well tubing or the well annulus, which moves an actuation piston in the firing head to initiate detonation of the perforating gun assembly. Firing head assemblies that utilize mechanical or hydraulic actuation generally include a firing pin 126 secured to the bottom of a piston 128 slidably mounted within a casing 130.

Supported in line, but spaced apart from firing pin 126 is a combustible initiator or booster 132. Combustible initiator 132 is attached to detonating cord 122, which, as described above, is secured to the shaped charges 118 aligned in a select radial direction. To detonate shaped charges 118, and thereby form perforations 68 in formation 12 in the select radial direction, a mechanical force or hydraulic pressure is applied to piston 128, driving firing pin 126 into contact with initiator 132 and thereby causing initiator 132 to combust, which in turn, causes detonating cord 122 to combust, which thereby causes combustion of shaped charges 118. To the extent two or more groups 124 of linearly arranged shaped charges are provided, firing head assembly 56 must likewise include multiple mechanisms for selectively detonating only the shaped charges 118 within a particular group. In any event, it will be appreciated that the disclosure is not limited to a particular firing head assembly and the foregoing is provided for illustrative purposes only.

Figure 5:
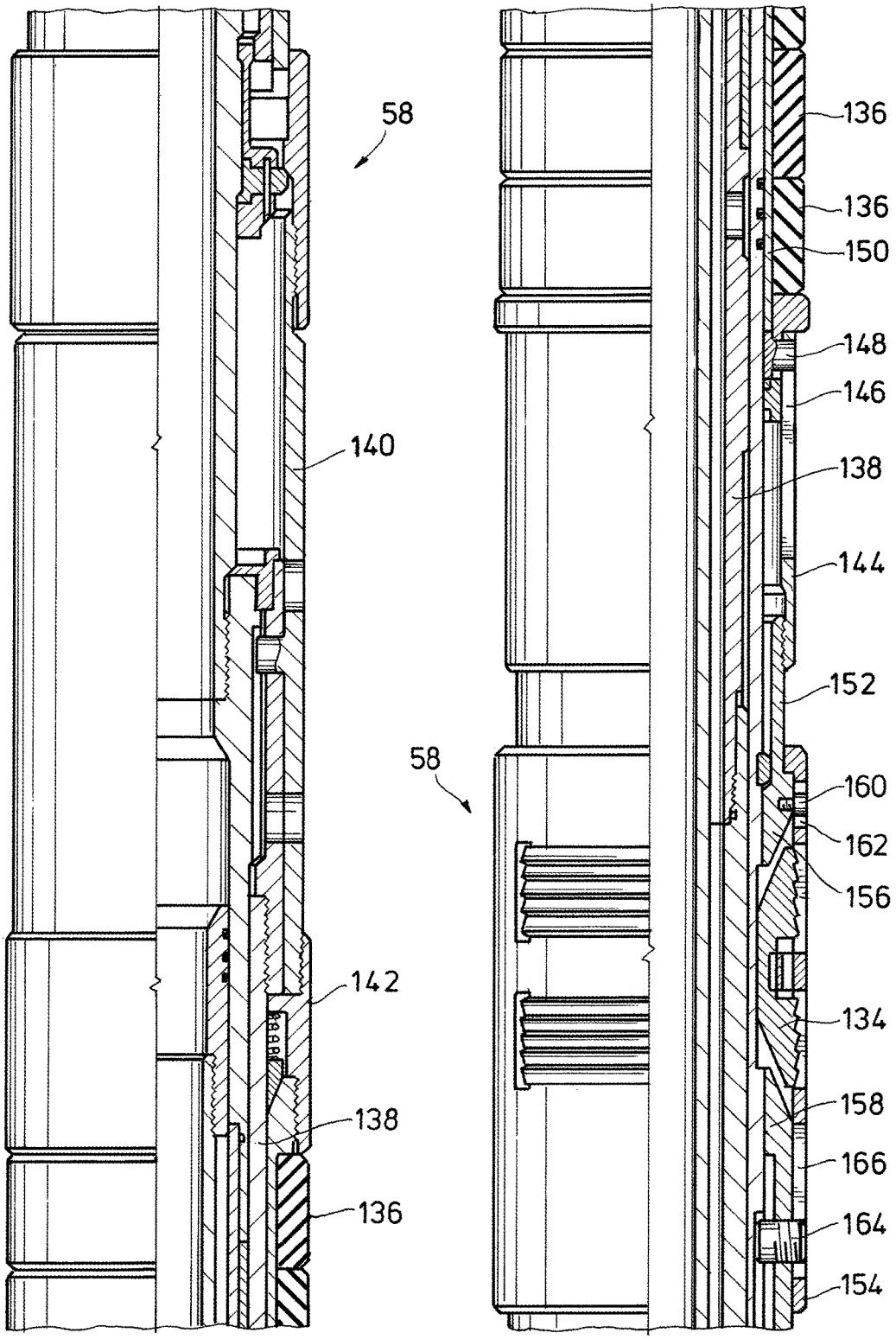
FIG. 5 illustrates a non-rotational packer that maybe disposed in a relief well according to some embodiments.

Turning to FIG. 5, a non-rotational packer is generally shown as 58. It will be appreciated that rotational packers are generally operated by applying a rotational force to the packers once positioned at a desired location in a wellbore, which rotational force may be used to set slips and expand sealing elements, for example. In contrast, non-rotational packers, such as is described herein, are generally operated through the application of axial forces in order to set slips and expand sealing elements. In one or more preferred embodiments, the perforating system 48 includes one or more non-rotational packers 58. It will be appreciated that because the latch assembly 52 requires rotation to ensure proper orientation of the perforating gun 54, it is desirable to utilize a packer that is operated by axial forces so that the packer would not be inadvertently operated by application of rotational forces utilized to orient perforating gun 54.

Although the disclosure is not limited to a particular type of non-rotational packer, FIG. 5 generally illustrates non-rotational packer 58 as having mechanically actuated anchor slips 134 which set the packer 58 against the inside bore of a tubing string 50 and expandable annular seal elements 136 which sealingly contact the inside of tubing string 50.

More specifically, the seal elements 136 are slidably mounted onto the external surface of a packer mandrel 138, and are displaced longitudinally and expanded radially as a setting force is applied downward by a force transmission device 140, such as a tube guide. The disclosure is not limited to any particular system for applying the setting force, and as such, the setting force may be actuated mechanically, hydraulically or by some other mechanism.

In any event, the seal elements 136 are confined axially between an upper compression member 142, such as a connecting sub, and a lower compression member 144, such as setting cylinder. As the tube guide 140 is moved downwardly by the axial setting force, the force is transmitted through the tube guide 140 and connecting sub 142 against the seal elements 136. Likewise, the setting force is transmitted to the setting cylinder 144, which engages the anchor slips 134. In one or more embodiments, the setting cylinder 144 has a longitudinal slot 146 in which a guide pin 148 is received. The seal elements 136 are carried by a slidable mandrel 150. The guide pin 148 is secured to the slidable mandrel 150. The guide pin 148 stabilizes and radially confines movement of the setting cylinder 144 relative to the tube guide 140, connecting sub 142 and slidable mandrel 150 as setting force is applied. Additionally, the guide pin 148 rotationally locks the setting cylinder 144 to the outer packer components to accommodate transfer of a rotational force through packer 58.

As mentioned, the setting force is transmitted to the anchor slips 134 through downward movement of the setting cylinder 144. More specifically, the setting cylinder 144 is coupled to a cam assembly 152 of the anchor slip 134. The cam assembly 152 extends between the external surface of the packer mandrel 138 and the cam surface of a slip carrier 154 to which outwardly facing slips 134 are attached. The cam assembly 152 includes a top cam 156, such as a top spreader cone, and a bottom cam 158, such as a bottom spreader cone, each with a cam surface disposed to engage the cam surface of the slip carrier 154. In one or more embodiments, the cam surfaces are frustoconical wedges which are generally complementary to an outwardly sloping, slanted upper cam surface of the slip carrier 154. Upon application of an axial force to the cam assembly 152 by the setting cylinder 144, the slip carrier 154 is forced radial outward, urging the slips 134 into contact with the wall of casing 64. Axial movement of the spreader cone 156 is stabilized by a cap screw 160. The cap screw 105 is slidably received within a longitudinal slot 162 which intersects the slip carrier 154. The shank of the cap screw 160 is fastened in a threaded bore in the top spreader cone 156 and projects radially into the slot 162, thereby preventing rotation of the spreader cone and upper wedge relative to the slip carrier 154.

When it is necessary to transmit a deviated bore, or a tight bend of a horizontal completion, occasionally high amounts of torque are required to be transmitted through the packer and into the lower section of perforating system 48. To enhance the transmission of torque through packer 58, an anti-rotation lug 164 which projects radially from the lower portion of bottom cam 158 is provided. The anti-rotation lug 164 projects into a longitudinal slot 166 of slip carrier 154. Longitudinal travel of the slip carrier 154 relative to the anti-rotation lug 164 is permitted by the slot 166 which is formed in the slip carrier 154. While the longitudinal slot 166 formed in the slip carrier 154 permits relative longitudinal movement of the slip carrier 154 relative to bottom cam 158, the radially projecting head portion of lug 164 provides a rotational lock between the slip carrier 154 and the bottom cam 158, thereby preventing rotation of the slip carrier 154 relative to the bottom cam 158 during running and setting operations.

Figure 6:
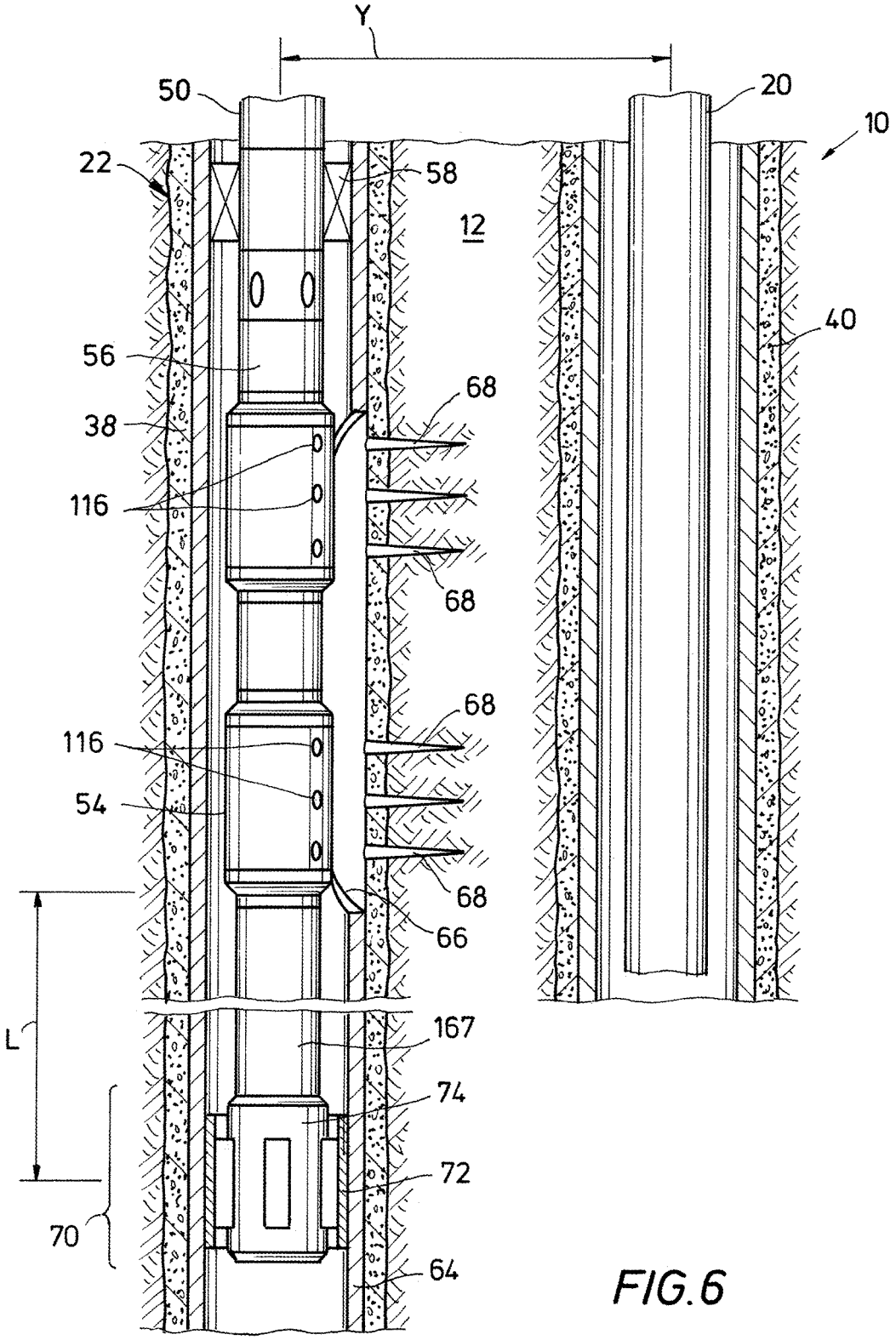
FIG. 6 illustrates a perforating system that may be used to establish fluid communication between a relief well and a target well.

Turning to FIG. 6, the aforementioned latch system 70, perforating gun 54, firing head 56 and non-rotational packer 58 are illustrated as forming perforating system 48 disposed in second wellbore 22. As shown, most of these various components are carried on a tubing 50, and perforating system 48 is positioned in the portion 38 of second wellbore 22 that is adjacent portion 40 of first wellbore 10. In one or more embodiments, first wellbore 10 includes a conductive body 20 which can be utilized to position portion 38 of second wellbore 22 adjacent first wellbore 10 utilizing known ranging techniques. Second wellbore 22 includes a casing 64 that carries the latch coupling 72 that forms part of the overall latch system 70.

In particular, there is shown a lower tubular 167 separating the latch assembly 52 from the perforating gun 54 a known length or distance "L". During make-up of perforating system 48, the length "L" of lower tubular 167 may be adjusted as necessary to position the perforating gun 54 adjacent the intended area of perforation. While the latch assembly 52 is preferably positioned below the perforating gun 54, it will be appreciated that in one or more embodiments, the latch assembly 52 could be positioned above the perforating gun 54 on lower tubular 167, so long as the relative axial distance "L" between the latch assembly 52 and the perforating gun 54 is known.

Also illustrated in FIG. 6 is the orientation of scallops 116 of perforating gun 54 in only a limited radial direction, namely in a radial direction such that the scallops 116 (and hence the charges 118 (not shown) associated with the scallops 116, facing first wellbore 10. In this regard, window 66 is illustrated with perforations 68 extending out into the formation 12 towards first wellbore 10.

Figure 7:
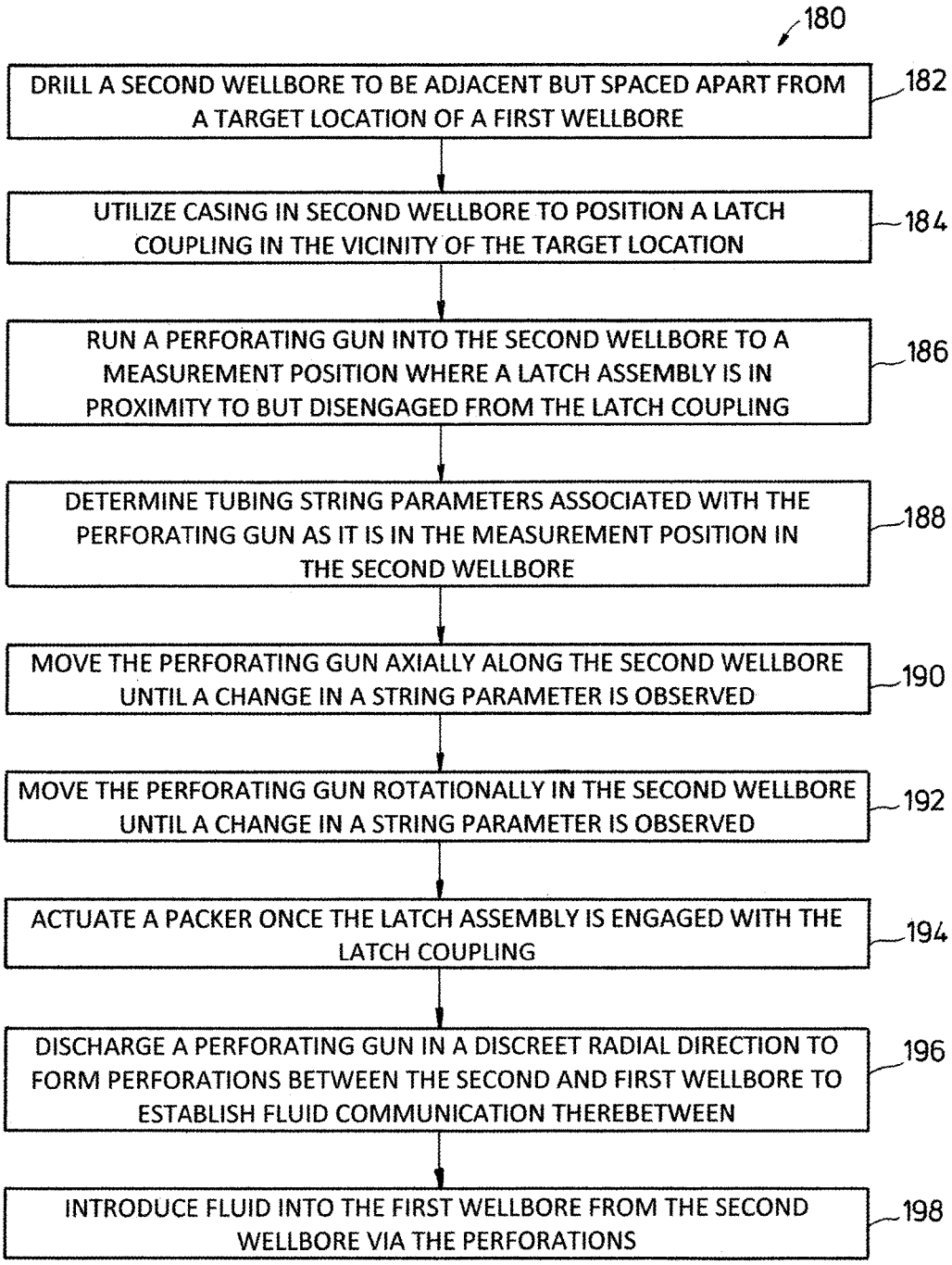
FIG. 7 shows a flow chart of one method for drilling a relief well and establishing hydraulic communication with a target well according to some embodiments.

With reference to FIG. 7, the operation of perforating system 48 will be explained. Illustrated in FIG. 7 is a method 180 for establishing fluid communication between a first wellbore and a second wellbore, and in particular, a target location along the first wellbore. Initially, in step 182, a second wellbore is drilled so that a portion of the second wellbore is adjacent, but spaced apart a distance "Y" from a portion of the first wellbore, i.e., a target location along the first wellbore, such as illustrated in FIG. 1. In the one or more preferred embodiments, the portion of the second wellbore is parallel to a portion of the length of the first wellbore, this portion of the length of the second wellbore being the target location where it is desired to establish fluid communication. Thus, a location is identified along the first wellbore at which fluid communication is to be established. In one or more embodiments, this location may be adjacent the casing shoe of the first wellbore, or adjacent a drill bit disposed in the first wellbore, or adjacent the distal end or lowest point of the first wellbore. The second wellbore is drilled so that the portion of the second wellbore adjacent the first wellbore is adjacent this desired target location for establishing fluid communication. In one or more embodiments, the second wellbore is drilled at least an axial distance "L" past this target location.

With the second wellbore drilled, in step 184, at least a portion of the second wellbore is cased in order to position a latch coupling along the length of the second wellbore, preferably in the vicinity of or in proximity to the portion of the second wellbore that is adjacent the target location of the first wellbore. In one or more embodiments, the second wellbore is cased to at least the axial distance "L" below the identified target location of the first wellbore. The casing may be installed and cemented in place as is well known in the industry. The casing at the axial distance "L" includes a latch casing section in which a latch coupling is installed in the casing, as described above. The latch casing is positioned in the second wellbore so that the latch coupling is in a particular orientation, using methods known in the art. While the latch assembly is preferably positioned below the perforating gun in makeup of a perforating system, in cases where the latch assembly is positioned above the perforating gun, then the latch casing section will likewise be positioned in the second wellbore an axial distance "L" above the location desired for establishing fluid communication. This distance "L" corresponds to the separation in a tool string between a perforating gun and a latch assembly, as described above.

In step 186, the perforating system, and in particular the perforating gun, is picked up and run into the second wellbore on a tubing string to a first or measurement position, wherein the perforating system is in the vicinity or proximity of the target location so that a latch assembly run in with the perforating gun is spaced apart from the latch coupling of the casing. It will be appreciated that at this point, when the perforating gun is in the first position, the latch assembly is not engaged with the latch coupling. In one or more embodiments, the perforating system is run into the second wellbore short of, i.e., upstream of, the target location. For example, the perforating system may be run into the second wellbore a distance of approximately 90 feet above or upstream of where the latch casing section is positioned in the second wellbore.

In any event, once the perforating system is positioned in the vicinity of or proximity to the target location, but before the latch assembly is engaged with the latch coupling, i.e., the first position, in step 188, one or more tubing string parameters are determined in order to establish baseline tubing string parameters against which further manipulation of the tool string can be compared. These tubing string parameters may include the weight of the tubing string, the torque required to rotate the tubing string at a select rate, the pick-up weight of the tubing string, the slack-off weight of the tubing string or the axial force need to urge the tubing string forward. Since the axial position of the perforating system in the wellbore effects these parameters, those skilled in the art will appreciate that these parameters cannot be accurately measured at the surface, but must be determined once the perforating system is at the approximate depth where fluid communication is to be established. In any event, as will be explained, thereafter, changes in one or more of these parameters can be utilized to orient the perforating gun. For example, a decrease or slack in the weight of a tubing string being lowered into the second wellbore indicates that the latch assembly on the tubing string may have landed in the latch coupling of the casing.

In step 190, the tubing string is urged forward in the second wellbore under a first axial force so that the latch assembly of the perforating tool 48 approaches the latch coupling mounted on the casing. In vertical wellbores, first axial force may be the weight of the tubing string and which may be sufficient to move the tubing string forward. In deviated wellbores, the first axial force may be an applied forced as required to move the tubing string forward. In any case, the tubing string is urged forward until a change is observed or identified in the tubing string parameters previously determined. In the case of a tubing string being lowered into a wellbore, such a change may be a decrease in weight or slack off in weight of the tubing string. In the case of a tubing string being pushed into the wellbore under an axial force, such a change may be an increase in the force needed to urge the tubing string forward. In any event, such a change signifies that the latch assembly of the perforating tool has engaged, is abutting or is otherwise adjacent the latch coupling of the casing.

In step 192, a rotational force is applied to the tubing string thereby causing the tubing string, and in particular the latch assembly carried by the tubing string, to rotate. In or or more embodiments, the rotational force is applied at the select rotational rate utilized during determination of tubing string parameters and the torque is observed. In one or more embodiments, the rotational force is applied at the same time or contemporaneously with, the tubing string is urged axially forward. In one or more embodiments, the tubing string is rotated at a comparatively slow rate, such as for example, in the approximate range of 5-10 revolutions per minute. Those skilled the art will appreciate that a rotational speed that is comparatively slow will allow a change in the tubing string parameters, and particularly, a change in the torque required to maintain the select rotational speed, to be readily identified.

As stated, in one or more embodiments, the tubing string is rotated and moved forward at the same time. As such, an operator may observe two changes in the tubing string parameters which together are indicative that the latch coupling has fully engaged the latch coupling. To the extent the wellbore is vertical, an operator may observe a slack off in weight, i.e., a change in the first axial force, coupled with an increase in torque, indicating that the latch assembly has landed in the latch coupling and that the latch assembly has rotated in the latch coupling until the spring loaded keys have engaged a radial recess, thereby rotationally securing the latch assembly to the latch coupling. The slack off in weight is due to the fact that the latch coupling is at least partially supporting the downward weight of the tubing string, while the increase in torque indicates that the keys of the latch assembly have engaged the radial recesses of the latch coupling. To the extent the latch is positioned in a horizontal or deviated portion of the second wellbore, an operator may observe an increase in the axial forced required to urge the tool string forward coupled with an increase in torque, indicating that the latch assembly has landed in the latch coupling and that the latch assembly has rotated in the latch coupling until the keys have engaged a radial recess, thereby rotationally securing the latch assembly to the latch coupling.

In either case, it will be appreciated that thereafter, an additional change in the tubing string parameters may be observed to indicate that the latch assembly has fully engaged the latch coupling as desired. Specifically, the pick-up weight will increase, the tubing string being constrained from upward or upstream axial movement by the engagement of the latch assembly with the coupling.

In any event, it will be appreciated that because a non-rotating packer is utilized in one or more embodiments, the rotational force is passed through the non-rotating packer to the latch assembly so as not to prematurely set the packer, thus allowing the latch assembly to be manipulated as described herein. Moreover, it will be appreciated that the latch system allows the charges of a perforating gun to be radially aligned so that only a select charge or set of charges are facing the target wellbore. In one or more embodiments, the perforating gun may have different sets of charges, such as for example, charges set for different depth or with different detonation characteristics, and the application of the axial and rotational forces can be manipulated to position or re-position a particular set of charges to face the target wellbore.

Thus, in one or more embodiments, once the latch system is engaged and a first set of charges is facing the target wellbore, based on one or more measured or observed parameters in the wellbore, the tubing string may be picked up or set down and rotated until the latch assembly has a different orientation in the latch coupling, and a second set of charges is facing the target wellbore.

In step 194, once the latch assembly has been seated in the latch coupling to the desired radial position, a packer is actuated. In one or more embodiments, the packer is actuated by applying a second axial force in order to actuate a non-rotational packer. Specifically, the second axial force is utilized to set the slips and expand the sealing element of the packer. In one or more embodiments, the weight of the tubing string is applied to the packer, shearing shear pins and thereby actuating the packer.

In step 196, with the latch system engaged and the packer set, the perforating gun is discharged. In one or more embodiments, only those perforating gun charges radially positioned to face the target wellbore are discharged. In one or more embodiments, where multiple sets of perforating gun charges may be carried by a perforating gun, only the set of charges facing in a desired direction of discharged. The perforations between the relief wellbore and the target wellbore establish fluid communication between the two wellbores. Moreover, in one or more embodiments where the perforations are radially oriented to extent only between the relief and target wellbores, inflow of wellbores fluids from the greater formation about the relief wellbore are minimized while maximizing fluid communication with the target wellbore. To the extent the target wellbore is cased, appropriate charges may be selected and utilized in the perforating gun in order to perforate the casing of the target wellbore. Moreover, if it is determined that sufficient fluid communication is not established by the first shot, the packer may be disengaged and the latch assembly re-oriented in the latch coupling in order to select a different set of charges for additional perforations. Once the perforating gun is re-oriented, the packer may be set as described herein and the perforating gun may be once again discharged to enhance the fluid communication between the relief wellbore and the target wellbore.

Finally in step 198, a fluid is introduced into the relief or second well and pumped or otherwise driven through the perforated area between the first and second wells and into the first well. Typically, such a procedure may be used to control pressure within the first well, such as when it is desired to disable the first well. Thus, the fluid is typically pumped under pressure. The fluid may be a drilling mud, cement or other gas, foam or fluid weighted material.

Thus, a system for establishing hydraulic flow from a relief wellbore to a target wellbore has been described. Embodiments of the system may generally include a latch assembly carried by a tubular string; a non-rotational packer carried by the tubular string; and a perforating gun carried by the tubular string. In other embodiments, a system for establishing hydraulic flow from a relief wellbore to a target wellbore may generally include a first well; a second well adjacent the first well along a portion of the length of the second well, the second well having casing disposed along said portion with a latch coupling carried by the casing of the second well, the latch coupling comprises a tubular casing section having a latch profile formed along an inner surface of the tubular casing; a latch assembly carried by a tubular string disposed in the second well, the latch assembly comprises a key housing having at least one circumferentially distributed, axially extending key window through which a spring operated latch key is radially outwardly biased, each latch key having an outward facing key profile; a non-rotational packer carried by the tubular string, the non-rotational packer comprises a packer mandrel having a seal element slidingly disposed thereon between an upper compression member and a lower compression member; a radially movable slip assembly having a cam surface and an axially movable cam assembly having a cam surface generally disposed to cooperate with the cam surface of the slip assembly; a radially extending lug carried by the packer and extending through at least one slot longitudinally formed in the packer, thereby constraining actuation of the packer to axial movement; and a perforating gun carried by the tubular string, the perforating gun comprises a tubular body disposed along an axis of the tubing tool string; and a plurality of charges longitudinally aligned along a portion of an axial length of the tubular body, the plurality of charges oriented to face outward from the body along a select radius, wherein the latch assembly is carried at a distal end of the tubular string; the perforating gun is disposed above the latch assembly along the tubular string; and the non-rotational packer is disposed on the tubular string above the perforating gun, and wherein the portion of the second well is drilled to be axially offset from and substantially parallel to a portion of the first well.

For any of the foregoing embodiments, the system may include any one of the following elements, alone or in combination with each other:

A first well; a second well adjacent the first well along a portion of the length of the second well, the second well having casing disposed along said portion with a latch coupling carried by the casing of the second well; wherein the latch assembly is carried at a distal end of the tubular string; the perforating gun is disposed above the latch assembly along the tubular string; and the non-rotational packer is disposed on the tubular string above the perforating gun.

A casing string extending along at least part of the length of the relief wellbore; the casing string including a latch coupling disposed adjacent a portion of the target wellbore; the latch assembly carried at a distal end of the tubular string; the perforating gun disposed above the latch assembly along the tubular string; and the non-rotational packer disposed on the tubular string above the perforating gun.

A latch assembly comprises a key housing having at least one circumferentially distributed, axially extending key window through which a spring operated latch key is radially outwardly biased, each latch key having an outward facing key profile; and the latch coupling comprises a tubular casing section having a latch profile formed along an inner surface of the tubular casing.

A latch profile comprises one or more grooves axially spaced from one another and one or more sets of recesses radially spaced from one another on the inner surface of the tubular casing.

A latch assembly is engaged with the latch coupling so that the key profile of at least one of the latch keys engages the latch profile, thereby positioning a charge in the perforating gun to face radially toward the first wellbore.

A perforating gun comprises a tubular body disposed along an axis of the tubing tool string; at least one charge carried by the tubular body and oriented to face outward from the body along a select radius.

A perforating gun comprises a plurality of charges longitudinally aligned along a portion of an axial length of the tubular body, the plurality of charges oriented to face outward from the body along the select radius.

A perforating gun comprises a plurality of charge sets, each set comprising a plurality of charges longitudinally aligned along a portion of an axial length of the tubular body, the plurality of charges of a set oriented to face outward from the body along a select radius.

The non-rotational packer comprises a packer mandrel having a seal element slidingly disposed thereon between an upper compression member and a lower compression member; a radially movable slip assembly having a cam surface and an axially movable cam assembly having a cam surface generally disposed to cooperate with the cam surface of the slip assembly; a radially extending lug carried by the packer and extending through at least one slot longitudinally formed in the packer, thereby constraining actuation of the packer to axial movement.

A portion of the second well is drilled to be axially offset from and substantially parallel to a portion of the first well.

A firing head located along the tubular string.

A lower extension section separating the latch assembly from the perforating gun and an upper extension section separating the non-rotational packer from the perforating gun.

A firing head located along the tubular string, a lower extension section separating the latch assembly from the perforating gun and an upper extension section separating the non-rotational packer from the perforating gun.

A first well having an axially extending section; a second well having an axially extending section substantially parallel with but spaced apart from the axially extending section of the first well, the axially extending section of the second well having the casing string disposed therein.

Thus, a method for establishing fluid communication between a first wellbore and a second wellbore in a formation has been described. Embodiments of the method may generally include positioning a perforating gun in the second wellbore upstream of a target location for perforation; determining at least one tubing string parameter associated with the perforating gun while in the upstream position; urging the tubing string downstream in the second wellbore until a change in the tubing string parameter is identified; applying torque to the tubing string until an increase in torque is identified thereby securing the perforating gun in a radial position; setting a non-rotating packer by applying an axial force to the non-rotating packer; and discharging the perforating gun in the direction of the first wellbore. In other embodiments, a method for establishing fluid communication may generally include drilling the second wellbore in the formation so that at least a portion of the length of the second wellbore is adjacent a portion of the length of the first wellbore; orienting a perforating gun in the second wellbore by engaging a latch coupling so that one or more charges of the perforating gun are facing the first wellbore; and actuating the perforating gun to discharge the charges and perforate the formation.

For any of the foregoing embodiments, the method may include any one of the following, alone or in combination with each other:

Setting a non-rotational packer once a the perforating gun has been oriented.

Drilling the second wellbore in the formation so that at least a portion of the length of the second wellbore is adjacent a portion of the length of the first wellbore; orienting a perforating gun in the second wellbore by engaging a latch coupling so that one or more charges of the perforating gun are facing the first wellbore; and actuating the perforating gun to discharge the charges and perforate the formation.

Discharging only those charges of the perforating gun that are facing the first wellbore.

Perforating only the formation between the second wellbore and the first wellbore.

Perforating only the formation between the second wellbore and the first wellbore.

Deploying casing in the second wellbore in the vicinity of the portion of the length of the second wellbore, wherein deploying comprises positioning at least one latch coupling in the casing string.

The tubing string parameter is the weight of the tubing string and the change in the tubing string parameter is a decrease in the weight.

The tubing string parameter is resistance to an axial force applied to urge the tubing string downstream in the wellbore and the change in the tubing string parameter is an increase in the resistance.

The step of urging and applying torque occur simultaneously.

The step of applying torque after a change in the tubing string parameter locks the tubing string into a latch coupling disposed along the casing of the second wellbore.

A discharge of the perforating gun comprises discharging only charges of the perforating gun axially oriented to face the first wellbore.

Determining comprises identifying the torque required to rotate the tool string at a first rotation speed.

The first rotation speed is approximately 5-10 rpms.

Applying the torque comprises rotating the tool string at the first rotation speed and monitoring for an increase in the torque while rotating the tubing string at the first rotation speed.

Engaging the latch coupling with a latch assembly in order to position the perforating gun within the portion of the length of the second wellbore.

The step of engaging comprises axially and radially positioning the perforating gun.

Deploying a non-rotating packer above the perforating gun.

Applying a rotational force and a first axial force to orient the perforating gun and applying a second axial force to actuate the non-rotational packer.

Transferring the rotational force through the non-rotational packer to engage the latch assembly.

Disabling the first wellbore by pumping the fluid into the second wellbore and through the perforations between the first and second wells.

Determining at least one tubing string parameter comprises determining the pick-up weight of the tubing string, the slack-off weight of the tubing string and the rotating torque of the tubing string at the perforating gun.

Lowering the tubing string until a weight loss is observed.

Rotating the tubing string until a torque increase is observed, and once a torque increase is observed with a weight loss, suspending rotation of the tubing string.

Slacking off weight in order to set a non-rotational packer.

Identifying a location along the length of the first wellbore for establishing hydraulic communication; and drilling the second wellbore so that the portion of the second wellbore is adjacent the identified location.

Axial force is applied by allowing the weight of the tubing string to shear pins securing the packer in a run-in configuration.

Positioning a perforating gun in the second wellbore upstream of a target location for perforation comprises positioning the perforating gun no more than approximately 90 feet upstream of the target location for perforation.

The target location is selected to be a portion of the second wellbore adjacent the distal end of the first wellbore.

Determining at least one tubing string parameter comprises determining the pick-up weight of the tubing string, the slack-off weight of the tubing string and the torque required to rotate the tubing string at a select rotation speed.

Positioning a casing section having a latch coupling mounted therein in proximity to a target location to be perforated.

Positioning a casing section having a latch coupling in the wellbore a distance L from the target location and the perforating gun is spaced apart on a tool string a distance L from a latch assembly carried by the tool string.

It should be understood by those skilled in the art that the illustrative embodiments described herein are not intended to be construed in a limiting sense. Various modifications and combinations of the illustrative embodiments as well as other embodiments will be apparent to persons skilled in the art upon reference to this disclosure. It is, therefore, intended that the appended claims encompass any such modifications or embodiments.

The invention claimed is:

1. A system for establishing hydraulic flow from a relief wellbore to a target wellbore, the system comprising:

a latch assembly carried by a tubular string; a non-rotational packer carried by the tubular string; a perforating gun carried by the tubular string; and a radially extending lug carried by the non-rotational packer and extending through at least one slot longitudinally formed in the non-rotational packer, thereby constraining actuation of the non-rotational packer to axial movement and transmitting torque from the tubular string above the non-rotational packer, through the non-rotational packer, to the latch assembly carried by the tubular string below the non-rotational packer.

2. The system of claim 1, further comprising:

a casing string extending along at least part of the length of the relief wellbore;

the casing string including a latch coupling disposed adjacent a portion of the target wellbore;

the latch assembly carried at a distal end of the tubular string;

the perforating gun disposed above the latch assembly along the tubular string; and the non-rotational packer disposed on the tubular string above the perforating gun.

3. The drilling system of claim 1, wherein the latch assembly comprises a key housing having at least one circumferentially distributed, axially extending key window through which a spring operated latch key is radially outwardly biased, each latch key having an outward facing key profile; and the latch coupling comprises a tubular casing section having a latch profile formed along an inner surface of the tubular casing.

4. The drilling system of claim 3, wherein the latch profile comprises one or more grooves axially spaced from one another and one or more sets of recesses radially spaced from one another on the inner surface of the tubular casing.

5. The drilling system of claim 3, wherein the latch assembly is engaged with the latch coupling so that the key profile of at least one of the latch keys engages the latch profile, thereby positioning a charge in the perforating gun to face radially toward the first wellbore.

6. The system of claim 1, wherein the perforating gun comprises a tubular body disposed along an axis of the tubing tool string; at least one charge carried by the tubular body and oriented to face outward from the body along a select radius.

7. The system of claim 6, wherein the perforating gun comprises a plurality of charges longitudinally aligned along a portion of an axial length of the tubular body, the plurality of charges oriented to face outward from the body along the select radius.

8. The system of claim 6, wherein the perforating gun comprises a plurality of charge sets, each set comprising a plurality of charges longitudinally aligned along a portion of an axial length of the tubular body, the plurality of charges of a set oriented to face outward from the body along a select radius.

9. The system of claim 1, wherein the non-rotational packer comprises a packer mandrel having a seal element slidingly disposed thereon between an upper compression member and a lower compression member; and a radially movable slip assembly having a cam surface and an axially movable cam assembly having a cam surface generally disposed to cooperate with the cam surface of the slip assembly.

10. The system of claim 2, wherein the portion of the second well is drilled to be axially offset from and substantially parallel to a portion of the first well.

11. The system of claim 6, further comprising: a firing head located along the tubular string.

12. The system of claim 1, further comprising a lower extension section separating the latch assembly from the perforating gun and an upper extension section separating the non-rotational packer from the perforating gun.

13. A system for establishing hydraulic flow from a relief wellbore to a target wellbore, the system comprising:

a casing string extending along at least part of the length of the relief wellbore;

the casing string including a latch coupling disposed adjacent a portion of the target wellbore;

a latch assembly carried by a tubular string disposed in the casing string, the latch assembly comprises a key housing having at least one circumferentially distributed, axially extending key window through which a spring operated latch key is radially outwardly biased, each latch key having an outward facing key profile;

a non-rotational packer carried by the tubular string, the non-rotational packer comprises a packer mandrel having a seal element slidingly disposed thereon between an upper compression member and a lower compression member; a radially movable slip assembly having a cam surface and an axially movable cam assembly having a cam surface generally disposed to cooperate with the cam surface of the slip assembly; a radially extending lug carried by the packer and extending through at least one slot longitudinally formed in the packer, thereby constraining actuation of the packer to axial movement; and a perforating gun carried by the tubular string, the perforating gun comprises a tubular body disposed along an axis of the tubing tool string; and a plurality of charges longitudinally aligned along a portion of an axial length of the tubular body, the plurality of charges oriented to face outward from the body along a select radius, wherein the latch assembly is carried at a distal end of the tubular string; the perforating gun is disposed above the latch assembly along the tubular string; and the non-rotational packer is disposed on the tubular string above the perforating gun such that the radially extending lug carried by the non-rotational packer transmits torque applied to the tubular string from above the non-rotational packer to the perforating gun and latch assembly below the non-rotational packer.

14. The system of claim 13, further comprising: a firing head located along the tubular string, a lower extension section separating the latch assembly from the perforating gun and an upper extension section separating the non-rotational packer from the perforating gun.

15. The system of claim 2 or 13, further comprising a first well having an axially extending section;

a second well having an axially extending section substantially parallel with but spaced apart from the axially extending section of the first well, the axially extending section of the second well having the casing string disposed therein.

16. A method of establishing fluid communication between a first wellbore and a second wellbore in a formation, the method comprising:

positioning a tubing string carrying a perforating gun and a non-rotational packer in the second wellbore upstream of a target location for perforation;

determining at least one tubing string parameter associated with the perforating gun while in the upstream position;

urging the tubing string downstream in the second wellbore until a change in the tubing string parameter is identified;

applying torque to the tubing string above the non-rotational packer and through a radially extending lug carried by the non-rotational packer to a latch assembly carried by the tubing string below the non-rotational packer until an increase in torque is identified thereby securing the perforating gun in a radial position;

setting the non-rotational packer by applying an axial force to the non rotational packer; and discharging the perforating gun in the direction of the first wellbore.

17. The method of claim 16, further comprising:

drilling the second wellbore in the formation so that at least a portion of the length of the second wellbore is adjacent a portion of the length of the first wellbore;

orienting a perforating gun in the second wellbore by engaging a latch coupling so that one or more charges of the perforating gun are facing the first wellbore; and actuating the perforating gun to discharge the charges and perforate the formation.

18. The method of claim 17, further comprising: discharging only those charges of the perforating gun that are facing the first wellbore.

19. The method of claim 16, wherein the tubing string parameter is the weight of the tubing string and the change in the tubing string parameter is a decrease in the weight.

20. The method of claim 16, wherein the tubing string parameter is resistance to an axial force applied to urge the tubing string downstream in the wellbore and the change in the tubing string parameter is an increase in the resistance.

21. The method of claim 16, wherein the step of urging and applying torque occur simultaneously.

22. The method of claim 16, wherein the step of applying torque is performed after a change in the tubing string parameter locks the tubing string into a latch coupling disposed along the casing of the second wellbore.

23. The method of claim 16, wherein the discharge of the perforating gun comprises discharging only charges of the perforating gun axially oriented to face the first wellbore.

24. The method of claim 16, wherein determining comprises identifying the torque required to rotate the tool string at a first rotation speed.

25. The method of claim 24, wherein the first rotation speed is approximately 5-10 rpms.

26. The method of claim 25, wherein applying the torque comprises rotating the tool string at the first rotation speed and monitoring for an increase in the torque while rotating the tubing string at the first rotation speed.

* * * * *